US012800223B2

(12) United States Patent
Barjhoux et al.

(10) Patent No.: US 12,800,223 B2
(45) Date of Patent: Nov. 17, 2026

(54) DEVICE AND METHOD FOR LIQUEFYING A FLUID SUCH AS HYDROGEN AND/OR HELIUM

(71) Applicant: L'Air Liquide, Societe Anonyme pour l'Etude et l'Exploitation des Procedes Georges Claude, Paris (FR)

(72) Inventors: Pierre Barjhoux, Sassenage (FR); Fabien Durand, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 560 days.

(21) Appl. No.: 18/276,676

(22) PCT Filed: Feb. 1, 2022

(86) PCT No.: PCT/EP2022/052295
§ 371 (c)(1),
(2) Date: Aug. 10, 2023

(87) PCT Pub. No.: WO2022/171485
PCT Pub. Date: Aug. 18, 2022

(65) Prior Publication Data

US 2024/0310116 A1 Sep. 19, 2024

(30) Foreign Application Priority Data

Feb. 10, 2021 (FR) ..... 2101245

(51) Int. Cl.

| | |
|---|---|
| ***F25J 1/02*** | (2006.01) |
| ***F01D 15/00*** | (2006.01) |
| ***F25J 1/00*** | (2006.01) |

(52) U.S. Cl.
CPC ..... *F25J 1/0288* (2013.01); *F01D 15/005* (2013.01); *F25J 1/0007* (2013.01); *F25J 1/001* (2013.01);
(Continued)

(58) Field of Classification Search
CPC ..... F25J 1/0288; F25J 1/0007; F25J 1/001; F25J 1/005; F25J 1/0072; F25J 1/0205;
(Continued)

(56) References Cited

U.S. PATENT DOCUMENTS 3,360,955 A * 1/1968 Witter ..... F25J 1/0037 62/332
4,161,107 A * 7/1979 Korsakov-Bogatkov ..... F25J 1/005 62/402
(Continued)

FOREIGN PATENT DOCUMENTS

EP 2211124 A1 7/2010
EP 3249319 A1 11/2017
(Continued)

OTHER PUBLICATIONS

Berstad, David O. et al., Large-scale hydrogen liquefier utilising mixed-refrigerant pre-cooling, Int'l Journal of Hydrogen Energy 35 (2010) 4512-4534.
(Continued)

*Primary Examiner* — Joel M Attey
*Assistant Examiner* — Brahim A. Michael Adeniji
(74) *Attorney, Agent, or Firm* — Justin K. Murray

(57) ABSTRACT

Disclosed is a device for liquefying a fluid, comprising a circuit for fluid to be cooled, the device comprising a set of one or more heat exchangers exchanging heat with the circuit of fluid to be cooled, at least one first cooling system exchanging heat with at least some of the set of one or more
(Continued)

heat exchangers, the first cooling system being a refrigerator with refrigeration cycle of a cycle gas mostly comprising helium, the refrigerator comprising, arranged in series in a cycle circuit: a cycle gas compression mechanism at least one cycle gas cooling member, a mechanism for expansion of the cycle gas and at least one expanded cycle gas heating member, wherein the compression mechanism comprises at least four compression stages in series, consisting of a set of one or more centrifuge-type compressors, the compression stages being mounted on shafts rotated by a set of one or more motors, the expansion mechanism comprising at least three expansion stages in series, consisting of a set of centripetal turbines, the at least one cycle gas cooling member being configured to cool the cycle gas at the outlet of at least one of the turbines and wherein at least one of the turbines is coupled to the same shaft as at least one compression stage so as to supply the compression stage with the mechanical work produced during the expansion.

18 Claims, 7 Drawing Sheets

(52) U.S. Cl.
CPC ..... *F25J 1/005* (2013.01); *F25J 1/0072* (2013.01); *F25J 1/0205* (2013.01); *F25J 1/0215* (2013.01); *F25J 2230/06* (2013.01); *F25J 2230/20* (2013.01); *F25J 2240/04* (2013.01); *F25J 2270/16* (2013.01)

(58) Field of Classification Search
CPC .... F25J 1/0215; F25J 2230/06; F25J 2230/20; F25J 2240/04; F25J 2270/16; F25J 1/0279; F25J 2290/34; F25J 1/0052; F25J 1/0062; F25J 1/0065; F25J 1/0214; F25J 1/0271; F25J 1/0284; F25J 1/0298; F01D 15/005
See application file for complete search history.

(56) References Cited

U.S. PATENT DOCUMENTS

| | | | | | |
|---|---|---|---|---|---|
| 4,267,701 | A * | 5/1981 | Toscano | F25J 1/0007 | 62/402 |
| 4,530,744 | A | 7/1985 | Smith | | |
| 5,205,134 | A | 4/1993 | Gistau-Baguer | | |
| 6,298,688 | B1 | 10/2001 | Brostow et al. | | |
| 7,409,834 | B1 * | 8/2008 | Ganni | F25B 9/002 | 62/608 |
| 2006/0225461 | A1 | 10/2006 | Paradowski | | |
| 2010/0135825 | A1 | 6/2010 | Walth | | |
| 2010/0263405 | A1 * | 10/2010 | Durand | F25J 1/0082 | 62/6 |
| 2010/0275616 | A1 * | 11/2010 | Saji | F25B 9/06 | 62/6 |
| 2017/0343012 | A1 | 11/2017 | Augy et al. | | |
| 2019/0120548 | A1 | 4/2019 | Pierre, Jr. et al. | | |
| 2020/0292211 | A1 * | 9/2020 | Saito | F25J 1/0065 | |

FOREIGN PATENT DOCUMENTS

| | | | | |
|---|---|---|---|---|
| EP | 3702588 | A1 | 9/2020 | |
| EP | 3368630 | B1 | 12/2020 | |
| FR | 3086707 | A1 | 4/2020 | |
| FR | 3098574 | A1 * | 1/2021 | F25J 1/0275 |
| JP | S63-271085 | | 11/1988 | |
| JP | H02171579 | A | 7/1990 | |
| JP | H05203343 | A | 8/1993 | |
| JP | 2007205667 | A | 8/2007 | |
| JP | 2009-121786 | | 6/2009 | |
| JP | 2010 025438 | A | 2/2010 | |
| JP | 2011-504574 | | 2/2011 | |
| JP | 2021 500524 | A | 1/2021 | |
| WO | 2017013213 | A1 | 1/2017 | |

OTHER PUBLICATIONS

He, T. et al., Optimal synthesis of expansion liquefaction cycle for distributed-scale LNG (liquefied natural gas) plant, Energy 88 (2015) 268-280.

Quack, H. et al., Nelium, a refrigerant with high potential for the temperature range between 20 and 70 K, Physics Procedia 67 (2015) 176-182.

Saji, N. et al., Design of oil-free simple turbo type 65 K-6 helium and neon mixture gas refrigerator for high temperature superconducting power cable cooling, AIP Conference Proceedings 613 (2020), published online May 15, 2002, 893-900.

Valenti, G. et al., Proposal of an innovative, high-efficiency, large-scale hydrogen liquefier, Int'l Journal of Hydrogen Energy 33 (2008) 3116-3121.

French Search Report for corresponding FR 2101245, Oct. 25, 2021.

International Search Report and Written Opinion for corresponding PCT/EP2022/052295, Apr. 21, 2022.

* cited by examiner

[Fig. 1]
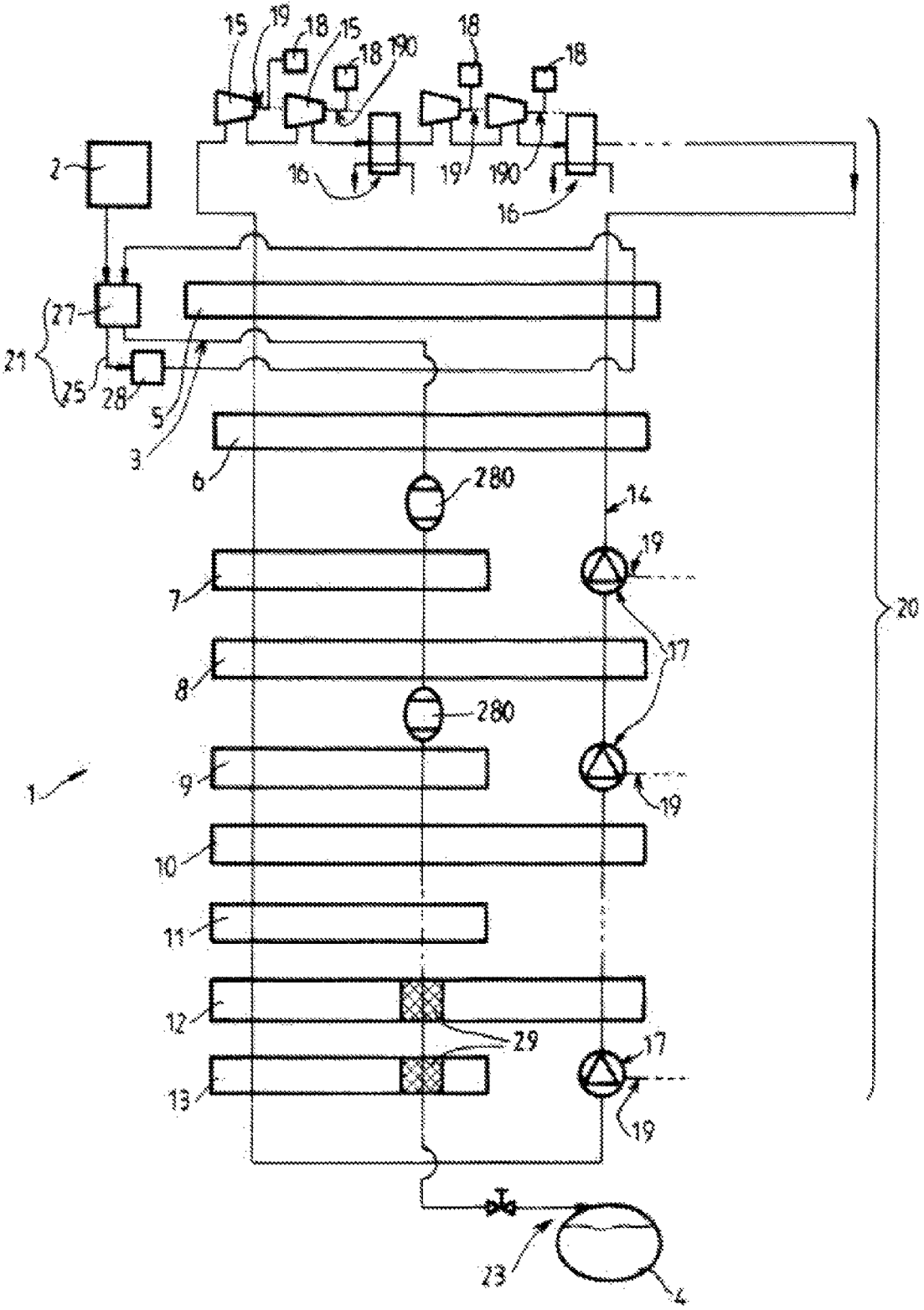

[Fig. 2]
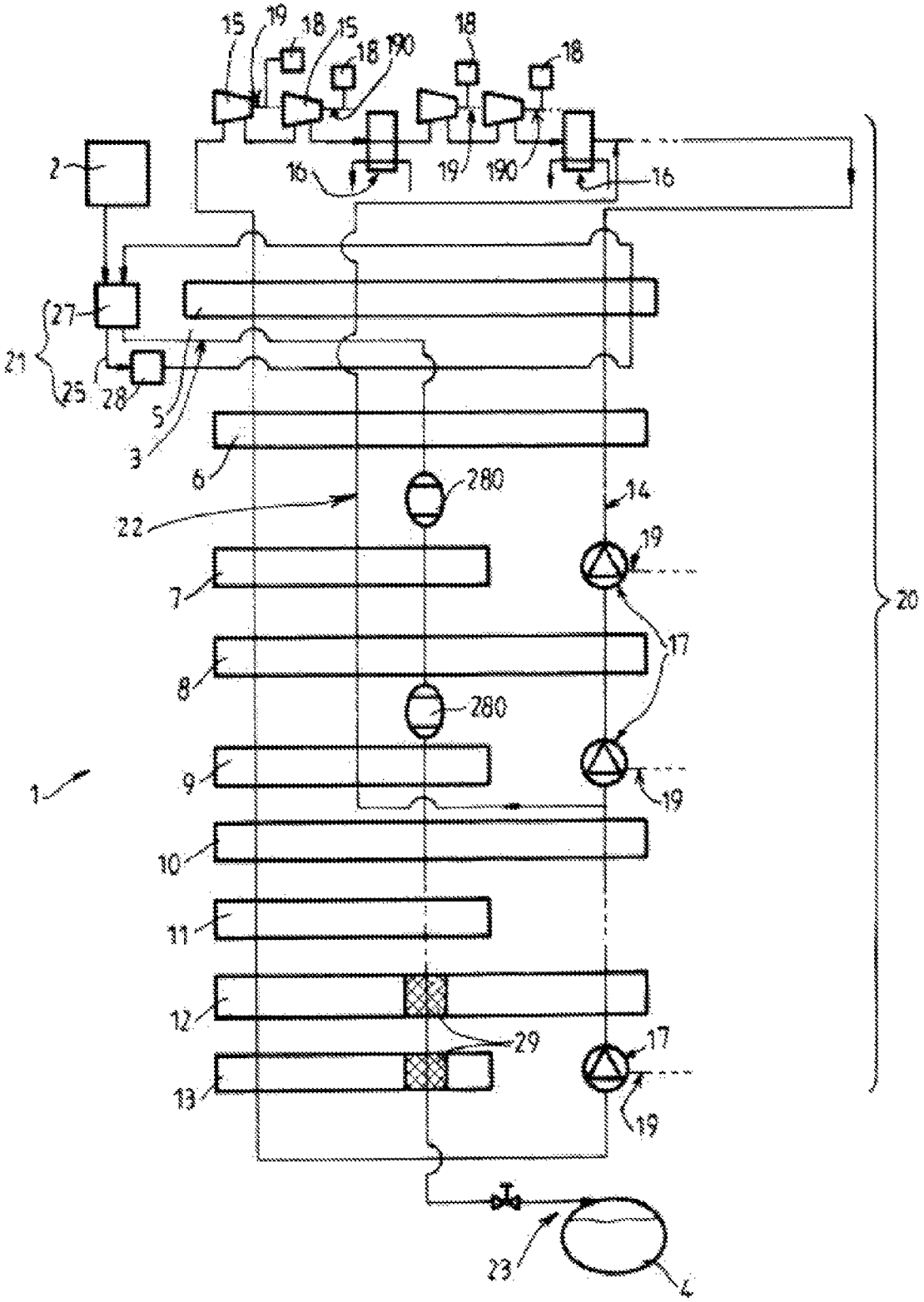

[Fig. 3]
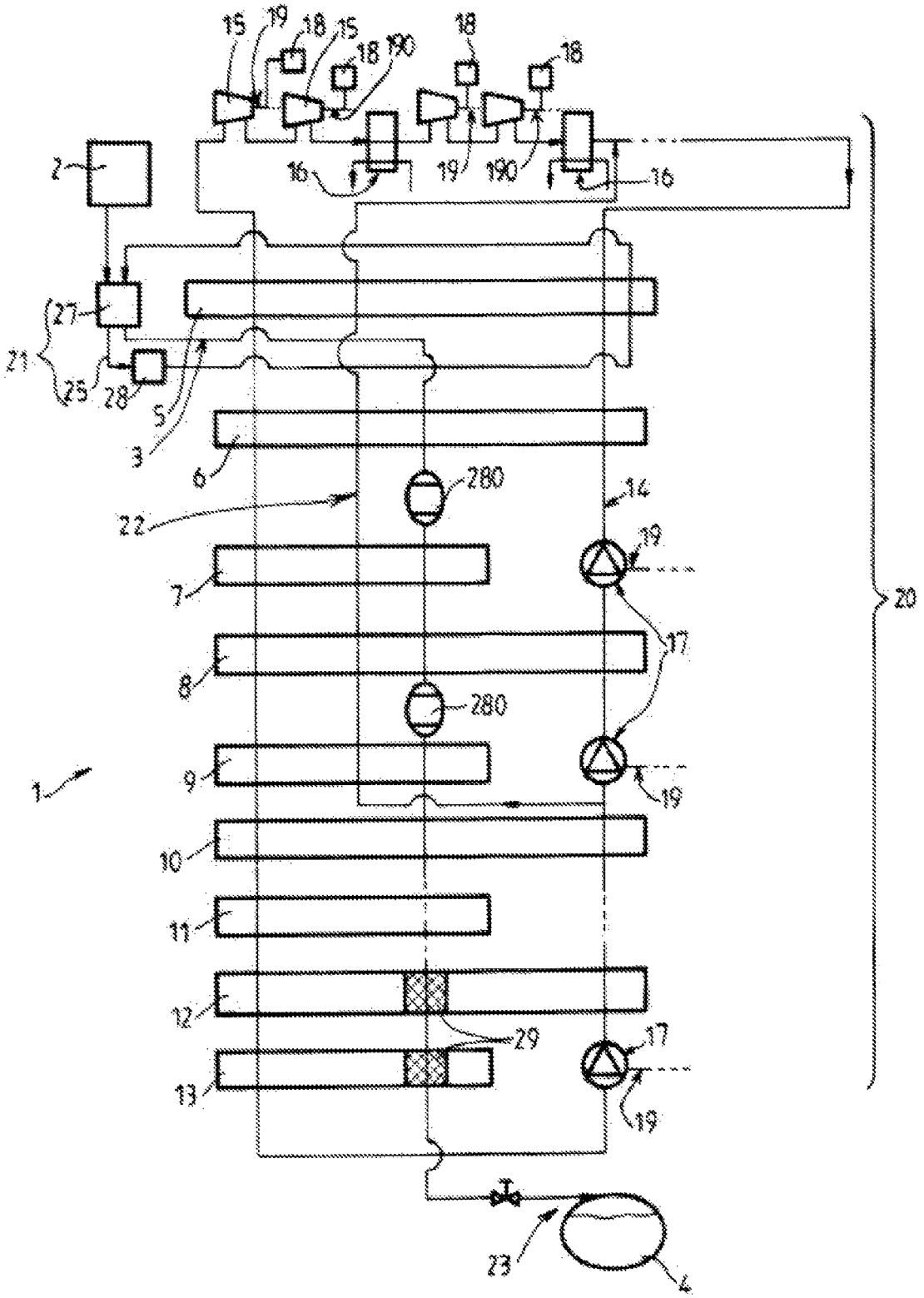

[Fig. 4]
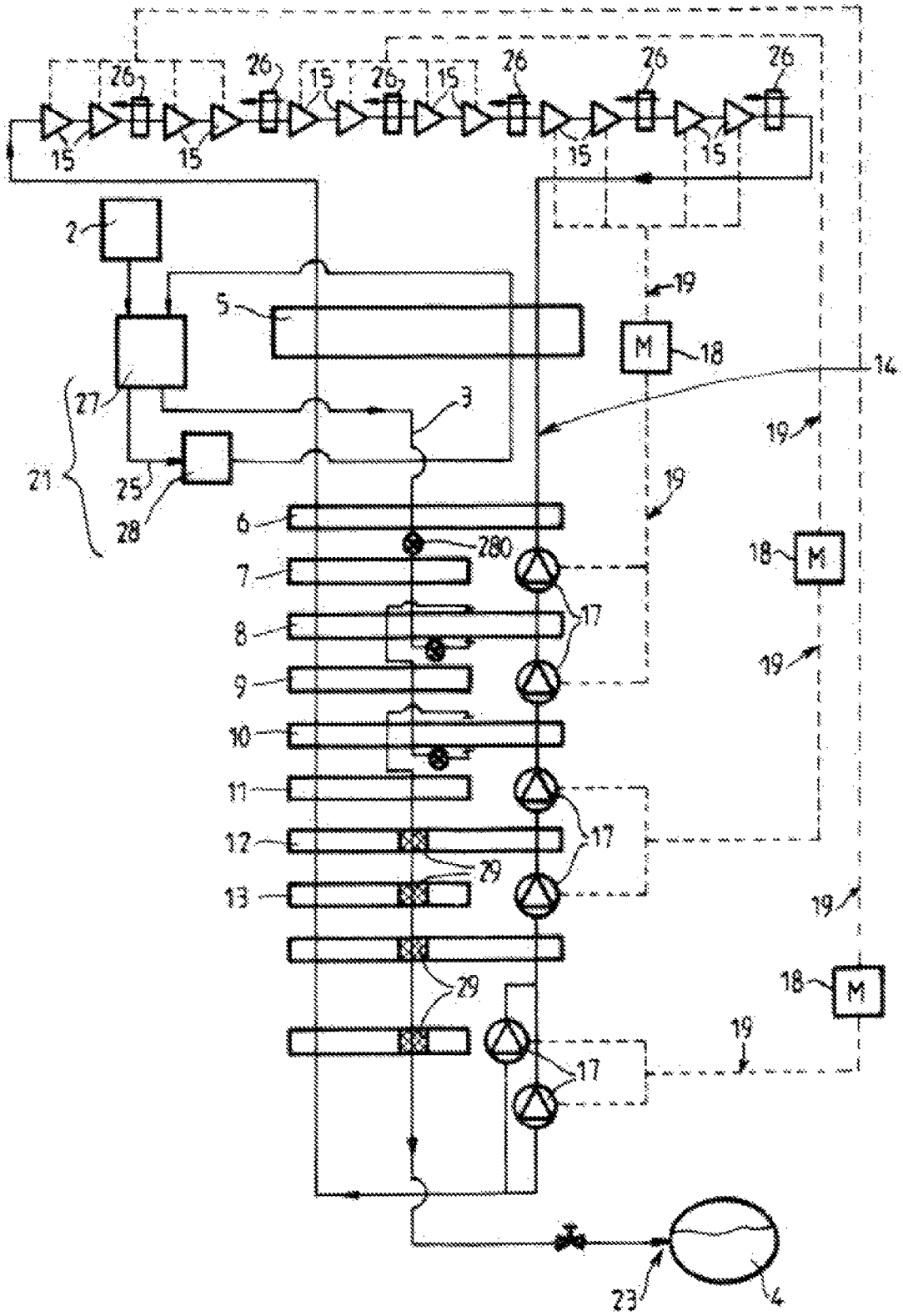

[Fig. 5]
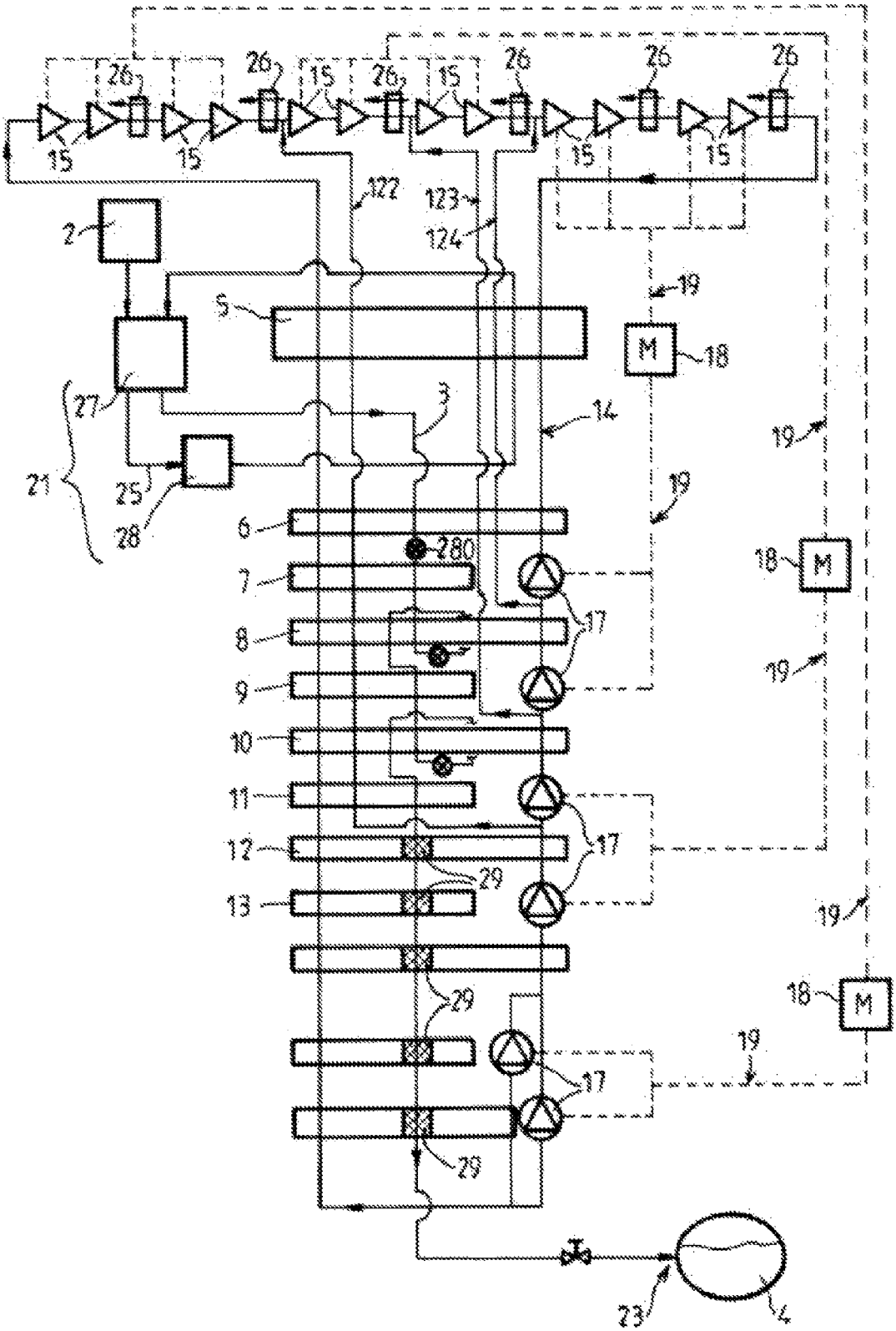

[Fig. 6]
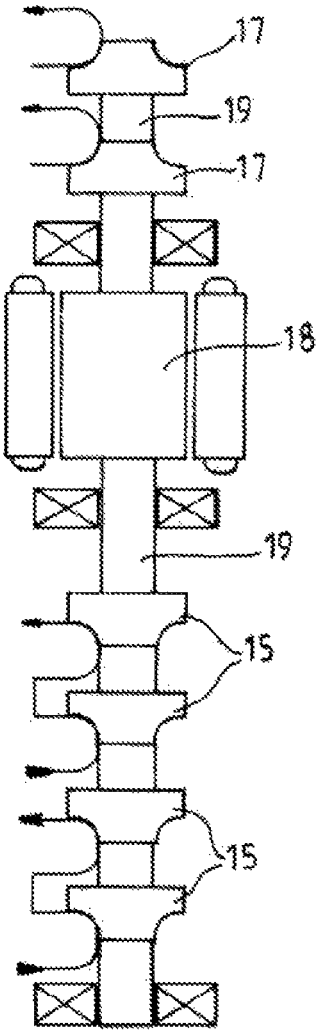
[Fig. 7]
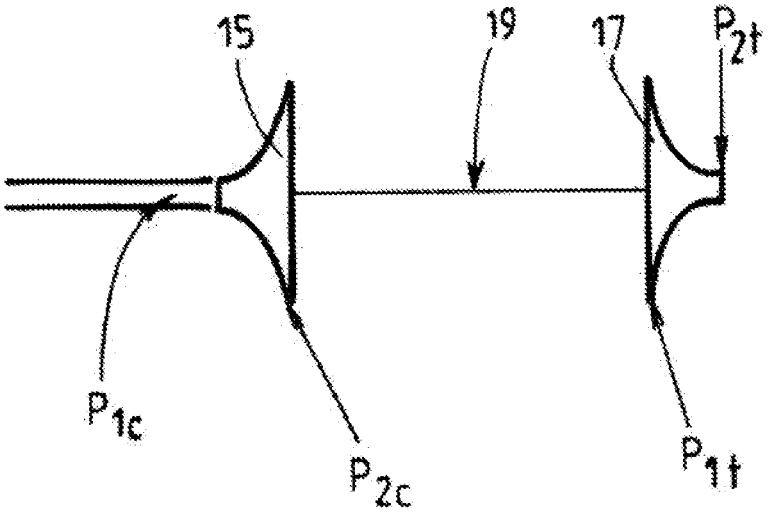

[Fig. 8]
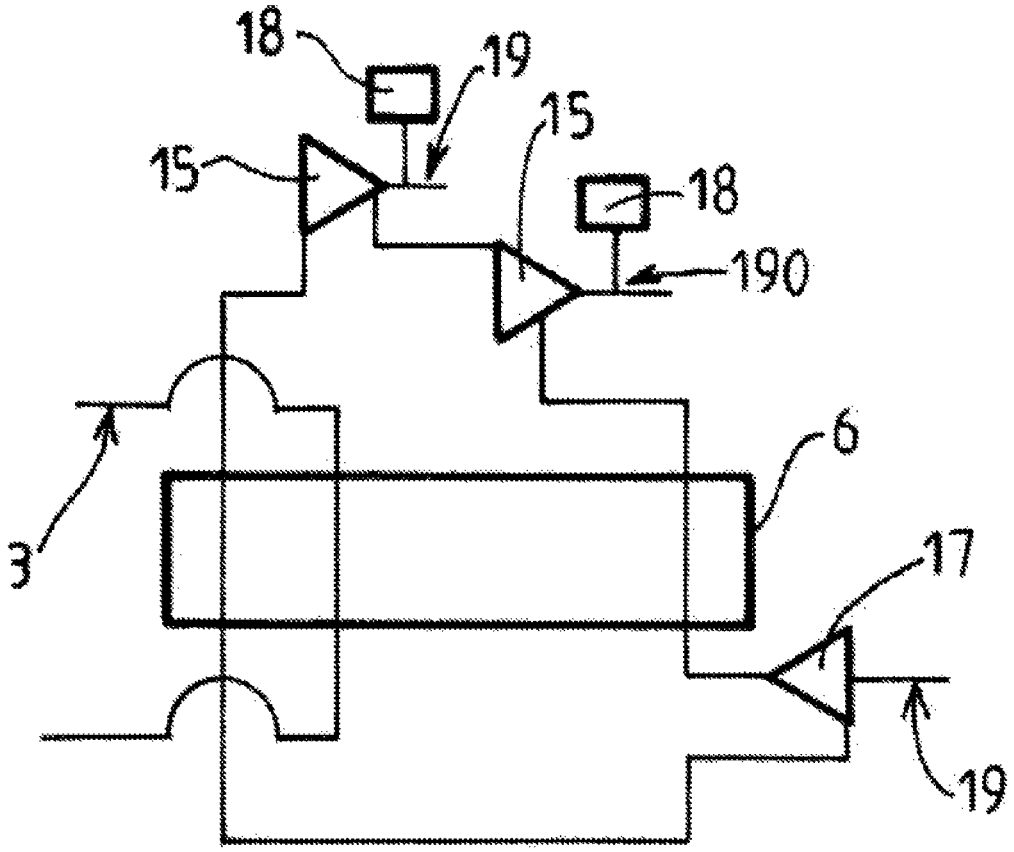

DEVICE AND METHOD FOR LIQUEFYING A FLUID SUCH AS HYDROGEN AND/OR HELIUM

CROSS REFERENCE TO RELATED APPLICATIONS

This application is a § 371 of International PCT Application PCT/EP2022/052295, filed Feb. 1, 2022, which claims the benefit of FR2101245, filed Feb. 10, 2021, both of which are herein incorporated by reference in their entireties.

FIELD OF THE INVENTION

The invention relates to a device and a process for liquefying a fluid such as hydrogen and/or helium.

BACKGROUND OF THE INVENTION

The prior-art solutions for liquefying hydrogen (H2) incorporate cycle compressors which obtain relatively low isothermal efficiencies (of about 60% to 65%) and have a relatively limited volumetric capacity at the cost, however, of quite considerable investment and high maintenance costs.

Document EP3368630 A1 describes a known process for liquefying hydrogen.

SUMMARY OF THE INVENTION

An aim of the present invention is to overcome all or some of the drawbacks of the prior art outlined above.

In certain embodiments, the invention relates more particularly to a device for refrigerating and/or liquefying a fluid such as hydrogen and/or helium, comprising a circuit for fluid to be cooled having an upstream end intended to be connected to a source of fluid and a downstream end intended to be connected to a member for collecting the fluid, the device comprising a set of heat exchanger(s) in heat exchange with the circuit for fluid to be cooled, the device comprising at least a first cooling system in heat exchange with at least part of the set of heat exchanger(s), the first cooling system being a refrigerator that performs a refrigeration cycle on a cycle gas, said refrigerator comprising the following, disposed in series in a cycle circuit: a mechanism for compressing the cycle gas, at least one member for cooling the cycle gas, a mechanism for expanding the cycle gas and at least one member for heating the expanded cycle gas, wherein the compression mechanism comprises a plurality of compression stages in series that are composed of a set of centrifugal impeller compressor(s), the compression stages being mounted on shafts that are driven in rotation by a set of motor(s), the expansion mechanism comprising at least one expansion stage composed of a set of centripetal turbine(s) having a determined working pressure at the inlet, and wherein the turbine, or respectively at least one of the turbines, is coupled to the same shaft as at least one compression stage so as to provide the mechanical work produced during the expansion to the compression stage.

In an effort to overcome the deficiencies of the prior art discussed, supra, the device according to the invention, which is otherwise in accordance with the generic definition thereof given in the above preamble, can include the at least one turbine and the corresponding compression stage that are coupled are structurally configured such that the pressure of the cycle gas exiting the turbine differs by no more than 40% and preferably by no more than 30% or by no more than 20% from the pressure of the cycle gas at the inlet of the compression stage, and/or the at least one turbine and the corresponding compression stage that are coupled are structurally configured such that the pressure of the cycle gas entering the turbine differs by no more than 40% and preferably by no more than 30% or by no more than 20% from the pressure of the cycle gas at the outlet of the compression stage.

Furthermore, embodiments of the invention may comprise one or more of the following features:

- the expansion mechanism comprises at least two expansion stages in series that are composed of a set of centripetal turbines in series, and in that, in the direction of circulation of the cycle gas, at least two turbines in series are coupled respectively to compression stages considered in the reverse order of their disposition in series, that is to say that at least one turbine is coupled to a compression stage situated upstream of a compression stage coupled to another turbine which precedes it in the cycle circuit,
- the expansion rate across the at least one turbine coupled to a compression stage is configured to produce a drop in pressure of the cycle gas of the value differs by no more than 40% from the value of the increase in pressure across the compression stage to which said turbine is coupled,
- the compression mechanism comprises solely centrifugal compressors,
- the expansion mechanism comprises solely centripetal turbines,
- the device comprises n turbines and k compressors, n and k being integers such that $k \geq n$,
- the mechanical coupling of the at least one turbine and of the compression stage or stages to one and the same shaft is configured to ensure an identical or substantially identical rotational speed of the turbine and of the compression stages that are coupled,
- the device comprises sixteen compression stages and eight turbines, or twelve compression stages and six turbines, or eight compression stages and four turbines, or six compression stages and three turbines, or four compression stages and three turbines, or three compression stages and two or three turbines, or two compression stages and one or two turbines,
- the set of heat exchanger(s) comprises at least one heat exchanger in which two separate portions of the cycle circuit under separate thermodynamic conditions perform circulation simultaneously in countercurrent operation for the cooling and the heating of the cycle gas, respectively.

The invention also relates to a process for producing hydrogen at cryogenic temperature, notably liquefied hydrogen, using a device according to any one of the features above or below, wherein the pressure of the cycle gas at the inlet of the mechanism for compressing the cycle gas lies between two and forty bar abs and notably lies between eight and thirty five bar abs.

According to other possibilities, the cycle gas comprises at least one of the following: helium, hydrogen, nitrogen, neon, freon, a hydrocarbon (to be completed), and/or the at least one member for cooling the cycle gas is configured to cool the cycle gas at the outlet of the at least one turbine or at the outlet of at least one of the turbines.

The invention may also relate to any alternative device or process comprising any combination of the features above or below within the scope of the claims.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

FIG. 1 shows a schematic and partial view illustrating the structure and the operation of a first possible exemplary embodiment of the invention, FIG. 2 shows a schematic and partial view illustrating the structure and the operation of a second possible exemplary embodiment of the invention, FIG. 3 shows a schematic and partial view illustrating the structure and the operation of a third possible exemplary embodiment of the invention, FIG. 4 shows a schematic and partial view illustrating the structure and the operation of a fourth possible exemplary embodiment of the invention, FIG. 5 shows a schematic and partial view illustrating the structure and the operation of a fifth possible exemplary embodiment of the invention, FIG. 6 shows a schematic and partial view illustrating a detail of the fourth possible exemplary embodiment of the invention, illustrating a possible example of the structure and operation of a motor-turbocompressor of the device?

FIG. 7 shows a schematic and partial view illustrating an example of a coupled turbine and compressor wheel with the respective inlet and outlet pressures, FIG. 8 shows a schematic and partial view illustrating another simplified embodiment.

DETAILED DESCRIPTION OF THE INVENTION

The device 1 for liquefying a fluid shown in FIG. 1 may be intended for the liquefaction of hydrogen but can also be applied to other gases, notably helium or any mixture. Equally, the device may ensure the cooling or the liquefaction of any other fluid: natural gas, helium, methane, biomethane, nitrogen, oxygen, neon, combination of these gases. The device 1 comprises a circuit 3 for fluid to be cooled (typically hydrogen) having an upstream end intended to be connected to a source 2 of gaseous fluid and a downstream end 23 intended to be connected to a member 4 for collecting the liquefied fluid. The source 2 may comprise typically an electrolyzer, a hydrogen distribution network, a steam methane reforming (SMR) unit or any other suitable source(s).

The device 1 comprises a set of heat exchangers 6, 7, 8, 9, 10, 11, 12, 13 disposed in series in heat exchange with the circuit 3 for fluid to be cooled. A single heat exchanger is also conceivable.

The device 1 comprises at least a first cooling system 20 in heat exchange with at least part of the set of heat exchangers 5, 6, 7, 8, 9, 10, 11, 12, 13.

This first cooling system 20 is a refrigerator that performs a refrigeration cycle on a cycle gas.

This cycle gas comprises, for example, at least one of the following: helium, hydrogen, nitrogen, neon, freon, a hydrocarbon.

This refrigerator 20 comprising the following, disposed in series in a cycle circuit 14 (preferably closed in the form of a loop): a mechanism 15 for compressing the cycle gas, at least one member 16, 5, 6, 8, 10, 12 for cooling the cycle gas, a mechanism 17 for expanding the cycle gas and at least one member 13, 12, 11, 10, 9, 8, 7, 6, 5 for heating the expanded cycle gas.

As illustrated, the set of heat exchanger(s) which cools the hydrogen to be liquefied preferably comprises one or a plurality of countercurrent heat exchangers 5, 6, 8, 10, 12 which are disposed in series and in which two separate portions of the cycle circuit 14 perform circulation simultaneously in countercurrent operation (respectively for the cooling and the heating of separate flows of the cycle gas).

That is to say that this plurality of countercurrent heat exchangers forms both a member for cooling the cycle gas (after the compression and after expansion stages, for example) and a member for heating the cycle gas (after the expansion and before the return to the compression mechanism).

The compression mechanism comprises at least two compression stages 15 composed of a set of centrifugal compressors that are disposed in series (and possibly in parallel).

A compression stage 15 may be composed of a wheel of a motorized centrifugal compressor.

The compression stages 15 (that is to say the compressor wheels) are mounted on shafts 19, 190 that are driven in rotation by a set of motor(s) 18 (at least one motor). Preferably, all the compressors 15 are of the centrifugal type.

For its part, the expansion mechanism comprises at least one expansion stage formed of centripetal turbine(s) 17 (disposed at least partially in series if there are a plurality of expansion stages. Preferably, all the turbines 17 are of the centripetal type and are mainly disposed in series).

At least one of the turbines 17 is coupled to the same shaft 19 as a compression stage 15 of a compressor so as to provide the mechanical work produced during the expansion to the compressor.

The at least one turbine 17 and the corresponding compression stage that are coupled are structurally configured such that the pressure P2*t* of the cycle gas exiting the turbine 17 differs by no more than 40% and preferably by no more than 30% or by no more than 20% from the pressure P1*c* of the cycle gas at the inlet of the compression stage 15 (cf. FIG. 7).

Equally, the at least one turbine 17 and the corresponding compression stage that are coupled are preferably also (or possibly alternatively) structurally configured such that the pressure of the cycle gas entering the turbine 17 differs by no more than 40% and preferably by no more than 30% or by no more than 20% from the pressure of the cycle gas at the outlet of the compression stage.

This combination of particular technical features (centrifugal compression, centripetal expansion, transfer of work from the turbines to the compressors and regulation of the pressures between the coupled compression and expansion wheels) improves the efficiency of the device with respect to the known solutions.

This structural configuration of the turbines (for example turbine wheel) and compression stages (for example compression wheel) means that these two elements are dimensioned (shape and/or dimension of the wheel and/or of their volute and/or of their inlet distributor, if appropriate) to respectively perform compressions and expansions of the same or similar absolute values as specified above. That is to say that, by design, these two coupled elements could reach these compression and expansion ratios (without using another active or passive element in the cycle circuit), preferably irrespective of the conditions of the flow of cycle gas.

For example, the expansion rate across the at least one turbine 17 coupled to a compression stage may be configured to produce a drop in pressure of the cycle gas, the value of which differs by no more than 40% or by no more than 20% from the value of the increase in pressure across the compression stage 15 to which said turbine is coupled.

Referring for example to FIG. 7, if the compressor 15 is coupled to the turbine 17 and operates between 10 bar and 15 bar (compression of the flow initially at P1*c*=10 bar to an outlet pressure P2*c*=15 bar), it is advantageous for the turbine 17 to cause this flow to expand to pressures of between 15 and 10 bar (P1*t*=15 bar and P2*t*=10 bar).

This improves the distribution and balancing of the axial forces of the shaft 19 which bears them.

Since the signs of the forces generated by the differences in pressure across the wheels 15, 17 are opposite, this tends to reduce the resultant of the axial forces.

This preferably also applies in the case of a plurality of turbines in series coupled to one or more compressors 15.

Thus, as illustrated, the expansion mechanism may comprise at least two expansion stages in series that are composed of a set of centripetal turbines 17 in series.

In addition, in the direction of circulation of the cycle gas, at least two turbines 17 in series are preferably coupled respectively to compression stages 15 considered in the reverse order of their disposition in series. That is to say that at least one turbine 17 is coupled to a compression stage 15 situated upstream of a compression stage 15 coupled to another turbine 17 which precedes it in the cycle circuit 14.

Preferably, the device comprises n turbines (expansion wheels or stages) and k compressor wheels or stages, where k≥=n. The expansion rate selected across each turbine 17 is thus preferably imposed as a function of the compressor to which they are coupled (as explained above).

The device 1 may comprise one or more motor-turbocompressors in part of the compression station. A motor-turbocompressor is an assembly comprising a motor, the shaft of which directly drives a set of compression stage(s) (wheel(s)) and a set of expansion stage(s) (turbine(s)). This makes use of the mechanical expansion work directly at one or more compressors of the cycle gas.

The at least one member 16, 5, 6, 8, 10, 12 for cooling the cycle gas may possibly be configured to cool the cycle gas at the outlet of at least one of the turbines 17. That is to say that, after expansion in a turbine 17, the cycle gas may be cooled by a value typically lying between 2 K and 30 K.

For example, and as illustrated, the device 1 comprises more compression stages 15 than turbines 17, for example twice as many or approximately twice as many. Each turbine 17 may be coupled to the same shaft 19 as a single respective compressor wheel 15 that is driven by a respective motor 18. It is possible for the other compressor wheel or wheels 15 (stage(s)) that are not coupled to a turbine 17 to be mounted only on rotary shafts 190 driven by separate respective motors 18 (motor-compressor).

As illustrated, the compression stages 15 that are coupled to a turbine 17 and the compressors that are not coupled to a turbine 17 may alternate in series in the cycle circuit 14.

The compression mechanism may comprise more than six compression stages in series. Of course, this is in no way limiting. The minimum compression rate (by the centrifugal technology) for achieving the liquefaction of hydrogen should preferably be about 1.3 to 1.6.

Four compression stages 15 in series make it possible notably to obtain very good isothermal efficiency with respect to the known solutions of piston compression, at the cost of a relatively significant mass flow rate of helium.

In the non-limiting example illustrated in FIG. 1, only four compression stages 15 and three turbines 17 are shown, but the device 1 could comprise eight compression stages 15 and four turbines 17. Any other distribution may be envisioned, for example sixteen compression stages 15 and eight turbines 17, or twelve compression stages and six turbines, or six compression stages and three turbines, or four compressors and three turbines, or three compression stages and two turbines (expansion stages), or two compression stages and one expansion stage, etc.

Cooling may be provided downstream of all or some of the compression stages or downstream of all or some of the compressors 15 (for example via a heat exchanger 16 cooled by a heat transfer fluid or any other refrigerant that is notably different from the cycle gas). This cooling may be provided after each compression stage or, as illustrated, every two compression stages 15 (or more) or solely downstream of the compression station. Surprisingly, this distribution of the cooling not at the outlet of each of the compression stages 15 in series but every two (or three) compression stages 15 makes it possible to obtain cooling performance while limiting the costs of the device 1.

Equally, the at least one member for cooling the cycle gas may optionally comprise a system 8, 10, 12 for cooling the cycle gas, such as a heat exchanger, disposed at the outlet of at least some of the turbines 17 in series.

This intermediate inter-expansion cooling makes it possible to limit the value of the high pressure necessary to reach the coldest temperatures of the cycle gas.

As illustrated in FIG. 1, the device 1 may comprise a system for cooling the cycle gas, such as a heat exchanger, at the outlet of all of the turbines 17 except for the last turbine 17 in series in the direction of circulation of the cycle gas. As illustrated, this cooling system may be provided by the aforementioned respective countercurrent heat exchangers 8, 10, 12.

This cooling after expansion enables temperature staging (that is to say makes it possible to reach different, increasingly lower temperatures after each expansion stage) to extract cold for the fluid to be cooled. This temperature staging is obtained by this arrangement and via a minimum compression rate obtained for supplying these different turbines 17.

The arrangement of a plurality of centrifugal compression stages 15 in series upstream makes it possible to obtain this pressure differential which enables sufficient staging of the cooling downstream. Specifically, for the same pressure difference, the more the temperature decreases, the more the enthalpy drop with constant entropy during the expansion decreases. The effect of the arrangement of the turbines 17 in series and the cooling 8, 10 at the outlet of the turbines is to increase the mean mass flow rate in the turbines 17 with respect to conventionally known staging. The theoretical isentropic efficiency thus tends to increase and therefore makes it possible to obtain better efficiencies of the turbines 17.

In particular, the cooling 8, 10 between the expansion stages allows the cycle fluid to reach the target liquefaction temperatures without requiring an even greater overall compression rate. The expansions are preferably isentropic or quasi-isentropic. That is to say that the cycle fluid is cooled progressively and the fluid liquefied.

Thus, the minimum temperature is reached directly at the outlet of the last quasi-isentropic expansion stage (that is to say downstream of the last expansion turbine 17). It is thus not necessary to additionally provide an expansion valve of the Joule-Thomson type downstream, for example. The cold and notably a supercooling temperature of the hydrogen to be liquefied can be obtained exclusively with the turbines 17 (extraction of work).

Preferably, most or all of the turbines 17 are coupled to one or more respective compressors 15.

As mentioned above, the successive turbines 17 are preferably coupled respectively to compression stages 15 of compressors considered in the reverse order of their disposition in series. That is to say that, for example, a turbine 17 is coupled to a compressor 15 situated upstream of a compressor 15 coupled to the turbine 17 which precedes it.

The order of combination of the turbines 17 and compressors that are coupled is therefore preferably at least partially reversed between the turbines and the compressors (in the cycle circuit, a turbine that is further upstream is coupled to a compressor that is further downstream).

Thus, in the case for example of an architecture with six compression stages 15 in series and three expansion stages in series, the first turbine 17 (that is to say the first turbine 17 after the compression mechanism) may be coupled to the fifth compressor 15 in series (fifth compression stage), while the second turbine 17 may be coupled to the third compressor 15 in series (third compression stage), the third turbine 17 may be connected to the first compressor 15 in series (first compression stage). It is possible for the other compressors 15 forming the other compression stages to not be coupled to a turbine (motor-compressor system and not motor-turbocompressors). Thus, the most powerful turbine 17 (the one furthest downstream) may be coupled to the first compression stage (the first compression stage intakes at the low pressure of the cycle). At this relatively low pressure level, the greater the compression rate of the compressor 15, the less the impact of the pressure drops at its level is felt (and so on with the other compressors 15).

This example above is, of course, in no way limiting. For example, the turbines 17 could be coupled respectively to the even-numbered compressors 15 (the first turbine to the sixth compressor, the second turbine to the fourth compressor, etc.) or to the compressors directly in series (for example the first turbine 17 to the sixth compressor 15, the second turbine to the fifth compressor, etc.).

In the example illustrated with alternation of a compressor 15 that is coupled to a turbine 17 and then a compressor 15 that is not coupled to a turbine, the working pressures of the turbines 17 may be set to the working pressures of the compressors 15 "one by one" or "two by two" (that is to say that the first turbine 17 works at the compression rate of the 5th or 6th compressors 15; equally, the second turbine 17 works at the compression rate of the 3rd or 4th compressors, etc.). If consideration is given to a pair of two compressors 15 in series (a compressor with a compression wheel that is coupled to a turbine followed by a compressor with a compressor wheel that is not coupled to a turbine), the first of these two compressors compresses for example the cycle gas to a first pressure PA while the second then compresses this cycle gas to a second pressure PB, where PB>PA. The turbine 17 which will be coupled to the first of these two compressors will preferably expand the cycle gas from the second pressure PB to the first pressure PA. This can be obtained, for example, by adjusting the characteristics of this turbine 17 in accordance with this constraint. For example, there is adjustment of the cross section of the distributor calibrating the flow rate arriving at the turbine 17, this having an effect on the resulting pressure drop in the distributor part and the turbine wheel part.

Thus, for example when turbines are coupled every two compression stages in series, the pressure relationships described in detail above (inlet/outlet) between the expansion and compression stages that are coupled can therefore be applied either solely to the compression stage that bears the turbine or to a set of two compressor wheels in series. In addition, the mechanical coupling or couplings of the turbines 17 and compressor wheels 15 to the same shaft 19 is (are) configured to ensure preferably an identical (or substantially identical) rotational speed of the turbine 17 and of the compressor wheels 15 that are coupled. This makes it possible to make direct and effective use of the expansion work in the device. If appropriate, the rotational speeds of all the compressor and turbine wheels may be equal to one and the same determined value.

A control member may optionally be provided for all or some of the compression stages. For example, a variable-frequency drive ("VFD") may be provided for each motor 18 driving at least one compression stage. This makes it possible to independently adjust the speeds of a plurality of compression stages or each compression stage and thus the expansion without using a complex system of gears or a drive and a specific control means linked to variable vanes upstream of one or more compression stages. This speed controlling member may be provided for the set of compressors or for each compression stage.

Preferably, the device 1 does not comprise a flow valve or a valve for reducing the pressure in the circuit (pressure drop) between the compression stages, between the expansion stages or downstream of the expansion of the cycle. Thus only isolating valves for maintenance purposes may be provided in the cycle circuit 14.

That is to say that the operating point of the turbines 17 (speed, pressure) can be regulated solely by way of the dimensional characteristics of the turbine 17 (no throttling valve at the turbine inlet, for example). This increases the reliability of the device (no potential problem involving failure of valves for controlling the process, since they are absent). This furthermore makes it possible to eliminate expensive ancillary circuits (safety valves, etc.) and simplifies manufacture (reduction in the number of lines to isolate, etc.).

The use of a helium-based cycle gas makes it possible to reach temperatures with a view to supercooling liquefied hydrogen without the risk of a subatmospheric zone within the process (this would be dangerous if the cycle fluid were hydrogen) and without the risk of freezing of the cold source (the maximum liquefaction temperature of helium is equal to 5.17 K). The effect of supercooling liquefied hydrogen has a very notable advantage for the transport chain of the hydrogen molecule and then potentially for users (typically liquid stations) by virtue of the reduction in boil-off gases during haulage.

It is thus possible to reach the freezing point (13 K) of the flow of hydrogen to be liquefied without crystallizing the cold source.

The low-pressure portion of the cycle circuit 14 may be operated at a relatively high pressure. This makes it possible to reduce the volumetric flow rates in the heat exchangers 6, 7, 8, 9, 10, 11, 12, 13. The working pressure of the cycle gas can thus be decorrelated from the pressure or the target temperature of the fluid to be cooled. This pressure of the cycle gas can thus be increased to adapt to the constraints of the turbomachine but also to reduce the volumetric flow rate at low pressure, which is generally one of the major parameters determining the dimensions of the heat exchangers.

This low pressure level in the cycle circuit 14 is for example greater than or equal to 10 bar and can typically lie between 10 and 40 bar. This reduces the volumetric flow rate in the heat exchangers, which counterbalances the low compression rate per compression stage.

As illustrated, the device 1 may comprise a second cooling system in heat exchange with at least part of the set of heat exchanger(s) 5 in heat exchange with the cycle gas, for example. This second cooling system 21 comprises, for example, a circuit 25 for heat transfer fluid such as liquid nitrogen or a mixture of refrigerants which cools the cycle gas and/or the hydrogen to be liquefied by means of the first countercurrent heat exchanger or the first countercurrent heat exchangers, and may also make it possible to combat losses by difference at the hot end caused by circulating the heat transfer fluid or fluids in a closed loop, as illustrated in FIG. 1 via at least one pre-cooling exchanger 5.

This second cooling system 21 makes it possible, for example, to pre-cool the fluid to be liquefied and/or the working gas at the outlet of the compression mechanism. This refrigerant circulating in the circuit 25 for heat transfer fluid (for example in a loop) is for example provided by a unit 27 for producing and/or storing 28 this refrigerant. If appropriate, the circuit 3 for fluid to be cooled passes through via this unit 27 in order to be pre-cooled upstream. It should be noted that it is conceivable for the device 1 to have other additional cooling system(s). For example, a third cooling circuit supplied by a chiller (for example providing a cold source at a temperature typically lying between 5° C. and −60° C.) may be provided in addition to the aforementioned system. A fourth cooling system could also be provided to again provide cold to the device 1 and increase the liquefaction power of the device 1 if required. The embodiment of FIG. 2 is distinguished from the preceding one solely in that the cycle circuit 14 comprises a return pipe 22 having a first end connected to the outlet of one of the turbines 17 (other than the last one downstream) and a second end connected to the inlet of one of the compressors 15 other than the first compressor 15 (upstream). This return pipe 22 makes it possible to return part of the flow of cycle gas to the compression mechanism at an intermediate pressure level between the low pressure at the inlet of the compression mechanism and the high pressure at the outlet of the compression mechanism.

The return pipe 22 may be in heat exchange with at least part of the countercurrent heat exchangers. A plurality of return pipes to the compression station at intermediate pressure may advantageously be installed depending on the desired level of optimization of the process. For example, the draw-off points (at the turbines under consideration) and injection points (at the compression stages under consideration) may be situated at different pressure levels.

The embodiment of FIG. 3 is distinguished from the preceding one solely in that the cycle circuit 14 further comprises a partial bypass pipe 24 having a first end connected upstream of a turbine 17 (for example the first upstream turbine 17) and a second end connected to the inlet of another turbine 17 situated downstream (for example the third turbine). For example, the bypass pipe 24 makes it possible to divert part of the flow of cycle gas exiting the compression mechanism at high pressure to the coldest turbines further downstream. The rest of the flow passes through this hotter first upstream turbine 17. This makes it possible, depending on the positioning in terms of specific speed of the various turbines and compressors, to adjust the flow rates sent to the various stages. For example, the compressors situated at higher pressure intake a lower volumetric flow rate than the first compression stages (situated close to the low pressure of the process). One way of increasing this volumetric flow rate and thus of potentially increasing their isentropic efficiency is to incorporate a return at intermediate pressure from the expansion stages, as shown in FIG. 3.

The device 1 shown in FIG. 4 illustrates yet another non-limiting embodiment. The elements that are identical to those described above are denoted by the same numerical references and are not described in detail again.

The cycle circuit 14 of the device of FIG. 4 comprises three compressors (driven respectively by three motors 18). As illustrated, each compressor may comprise four compression stages 15 (that is to say four compression wheels in series). These compressor wheels 15 may be mounted by direct coupling to one end of a shaft 19 of the motor 18 in question. In this example, the device therefore has twelve centrifugal compression stages in series. As shown, cooling 26 of the cycle gas may be provided every two compression stages.

In this example, the device 1 has five expansion stages in series (six centripetal turbine wheels, two of which are disposed in parallel), for example one or two expansion stages per compressor. As illustrated, all of the turbines 17 may be coupled to a compressor shaft 19 (for example two turbines 17 are mounted at the other end of the shaft 19 of each motor 18 to provide the mechanical work to the compressor wheels 15 that are also mounted on this shaft 19). Of course, the turbines 17 could be on the same side of the shaft 19 as the compression wheels 15. For example, the four first expansion stages are formed of four turbines 17 in series. The fifth expansion stage is for example formed of two turbines 17 disposed respectively in two branches in parallel of the cycle circuit 14.

The device 1 shown in FIG. 5 is distinguished from that of FIG. 4 in that it comprises return lines 122, 123, 124 for cycle gas that transfer part of the cycle gas exiting the turbines 17 at intermediate pressure levels (medium pressure) within the compression mechanism. For example, a line 124 connects the outlet of the first turbine to the outlet of the eighth compression stage. Equally, a line 123 connects the outlet of the second turbine to the outlet of the sixth compression stage. Equally, a line 122 connects the outlet of the third turbine 17 to the outlet of the fourth compression stage. Of course, the device could have just one or just two of these medium-pressure return lines. Equally, other return lines could be envisioned. In addition, the ends of these lines could be changed (outlet of other turbine(s) and outlet(s) of other compression stages).

This or these returns make it possible to increase the volumetric flow rate of the compressors thus supplied with a flow rate excess and thus to potentially increase their isentropic efficiency.

The device 1 shown in FIG. 6 illustrates a detail of the device 1 illustrating a non-limiting possible example of the structure and operation of a motor-turbocompressor arrangement. One end of the shaft 19 of the motor 18 drives four compressor wheels (four compression stages 15). The other end of the shaft 19 is coupled directly to two expansion stages (two turbines 17).

Of course, any other suitable type of arrangement of the compression stages 15 and expansion stage 17 (number and distribution) may be envisioned (likewise for the number of motors). Thus other modifications are possible.

Various configurations are therefore possible for the turbines 17, notably for the downstream turbines (the coldest ones).

For example, as already illustrated, the two last expansion stages (two turbines) may be installed in parallel and not in series. This makes it possible to effect a greater enthalpy drop across these turbines. This would be realized to the detriment of the efficiency (since two turbines would share 100% of the flow rate and the available pressure difference would be almost doubled). In spite of this potential drop in efficiency for these two last expansion stages, realizing a greater enthalpy drop could allow the expansion to be staged more effectively.

This is because the same enthalpy differential in cold conditions causes a variation in temperature across a turbine that is smaller than in the case of a hotter turbine. This improves the efficiency of the refrigeration and liquefaction process. Thus, in spite of a relatively reduced temperature differential across the turbines, the efficiency of the device makes it possible to liquefy hydrogen with good energy efficiency.

The temperature differential caused by the turbine 17 may be a function of the temperature of the cycle gas upstream of the turbine 17.

A buffer tank (not shown) and a set of valve(s) may be provided, preferably at the low pressure level, with the aim of limiting the maximum pressure for filling the cooling circuit with gas.

Preferably, the minimum compression rate lies between 1.3 and 1.6 across the compression station. The cycle gas may be composed 100% or 99% of helium and supplemented by hydrogen, for example.

The cycle circuit may comprise, at the inlet of at least one of the turbines 17, an inlet guide vane ("IGV") configured to regulate the flow rate of fluid to a determined operating point.

In addition, the arrangement of the compressor wheels 15 and/or turbines 17 is not limited to the examples above. Thus, the number and arrangement of the compressors 15 may be modified. For example, the compression mechanism could be composed of only three compressors, each compressor could be provided with a plurality of compression stages, for example three compression stages, that is to say three compressor wheels (with or without inter-stage cooling).

FIG. 8 illustrates another example with two compression stages (wheels) in series and one expansion stage (wheel).

Equally, two compression stages 15 could be disposed in parallel and in series with other compression stages (for example three in series). The two compression stages in parallel can be placed upstream of the others and thus provide, in the downstream direction, a relatively high flow rate at the low pressure by using machines which may all be identical.

In the same way, turbines 17 can be placed in parallel in the cycle circuit 14.

In addition, as already illustrated, all of the turbines could be coupled to one or more compressor wheels (for example one or more turbines 17 coupled to the same shaft 19 as one or more compression stages).

As illustrated, the circuit 3 for fluid to be cooled may comprise one or more catalysis members (converter(s) 280) outside of exchangers or section(s) 29 of exchanger(s), for example for (ortho-para) hydrogen conversion.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A device for refrigerating and/or liquefying a fluid selected from the group consisting of hydrogen, helium, and combinations thereof, the device comprising:

a circuit for fluid to be cooled having an upstream end configured to be connected to a source of fluid and a downstream end configured to be connected to a member for collecting the fluid;

a set of heat exchanger(s) in heat exchange with the circuit for fluid to be cooled;

at least a first cooling system in heat exchange with at least part of the set of heat exchanger(s), the first cooling system being a refrigerator that performs a refrigeration cycle on a cycle gas, wherein said refrigerator comprises the following, disposed in series in a cycle circuit:

a compression mechanism configured to compress the cycle gas, at least one cooling member configured to cool the cycle gas, an expansion mechanism configured to expand the cycle gas, and at least one heating member configured to heat the expanded cycle gas, wherein the compression mechanism comprises a plurality of compression stages in series that are composed of a set of centrifugal impeller compressor(s), wherein the compression stages are mounted on shafts that are driven in rotation by a set of motor(s), wherein the expansion mechanism comprises at least one expansion stage composed of a set of centripetal turbine(s) having a determined working pressure at the inlet, and wherein the turbine, or respectively at least one of the turbines, is coupled to the same shaft as at least one compression stage so as to provide the mechanical work produced during the expansion to the compression stage, wherein the at least one turbine and the corresponding compression stage that are coupled are structurally configured such that the pressure of the cycle gas exiting the turbine differs by no more than 40% from the pressure of the cycle gas at the inlet of the compression stage, and wherein the at least one turbine and the corresponding compression stage that are coupled are structurally configured such that the pressure of the cycle gas entering the turbine differs by no more than 40% from the pressure of the cycle gas at the outlet of the compression stage, and wherein the expansion rate across the at least one turbine coupled to a compression stage is configured to produce a drop in pressure of the cycle gas, the value of which differs by no more than 40% from the value of the increase in pressure across the compression stage to which said turbine is coupled.

2. The device as claimed in claim 1, wherein the expansion mechanism comprises at least two expansion stages in series that are composed of a set of centripetal turbines in series, and in that, in the direction of circulation of the cycle gas, at least two turbines in series are coupled respectively to compression stages considered in the reverse order of their disposition in series, that is to say that at least one turbine is coupled to a compression stage situated upstream of a compression stage coupled to another turbine which precedes it in the cycle circuit.

3. The device as claimed in claim 1, wherein the compression mechanism comprises solely centrifugal compressors.

4. The device as claimed in claim 1, wherein the expansion mechanism comprises solely centripetal turbines.

5. The device as claimed in claim 1, wherein the device comprises n turbines and k compressors, n and k being integers such that k is greater than or equal to n.

6. The device as claimed in claim 1, wherein the mechanical coupling of the at least one turbine and of the compression stage or stages to one and the same shaft is configured to ensure an identical rotational speed of the turbine and of the compression stages that are coupled.

7. The device as claimed in claim 1, wherein the device comprises sixteen compression stages and eight turbines, or twelve compression stages and six turbines, or eight compression stages and four turbines, or six compression stages and three turbines, or four compression stages and three turbines, or three compression stages and two or three turbines, or two compression stages and one or two turbines.

8. The device as claimed in claim 1, wherein the set of heat exchanger(s) comprises at least one heat exchanger in which two separate portions of the cycle circuit under separate thermodynamic conditions perform circulation simultaneously in countercurrent operation for the cooling and the heating of the cycle gas, respectively.

9. The device as claimed in claim 1, further comprising a second cooling system in heat exchange with at least part of the set of heat exchanger(s), said second cooling system comprising a circuit for heat transfer fluid such as liquid nitrogen or a mixture of refrigerants.

10. A process for producing hydrogen at cryogenic temperature, notably liquefied hydrogen, using the device as claimed in claim 1, the process comprising the step of setting the pressure of the cycle gas at the inlet of the compression mechanism to be between two and forty bar abs.

11. The process for producing hydrogen at cryogenic temperature as claimed in claim 10, wherein the pressure of the cycle gas at the inlet of compression the mechanism is between eight and thirty five bar abs.

12. The device as claimed in claim 1, wherein the cycle circuit is devoid of a Joule-Thomson expansion valve downstream of the expansion mechanism.

13. The device as claimed in claim 1, wherein the turbines are configured to obtain a supercooling temperature of the fluid to be cooled exclusively through the extraction of work.

14. The device as claimed in claim 1, wherein the cycle circuit does not comprise a flow valve or a pressure-reducing valve between the compression stages or between the expansion stages, such that the operating point of the turbines is regulated solely by the dimensional characteristics of the turbines.

15. The device as claimed in claim 1, wherein the cycle circuit comprises at least one return pipe (22) having a first end connected to the outlet of a turbine and a second end connected to the inlet of a compression stage other than the first compression stage in the series, configured to return a portion of the cycle gas at an intermediate pressure level.

16. The device as claimed in claim 1, further comprising a partial bypass pipe (24) having a first end connected upstream of a first turbine and a second end connected to the inlet of a downstream turbine, configured to adjust the volumetric flow rates sent to different expansion stages.

17. The device as claimed in claim 1, wherein the expansion mechanism comprises at least two turbines installed in parallel at the coldest end of the refrigeration cycle, configured to effect a greater enthalpy drop than if the turbines were arranged in series.

18. The device as claimed in claim 1, wherein the at least one turbine and the corresponding compression stage are structurally configured to produce opposing axial forces on the common shaft, such that the resultant axial force on the shaft is reduced during operation.

* * * * *